US008555782B2

(12) United States Patent
Liao

(10) Patent No.: US 8,555,782 B2
(45) Date of Patent: Oct. 15, 2013

(54) GARBAGE BIN COVER WITH COMPRESSING FUNCTION

(75) Inventor: Henry Liao, Guangdong Province (CN)

(73) Assignee: Jiangmen Foreign Trade Group Co., Ltd., Guangdong Province (CN)

( * ) Notice: Subject to any disclaimer, the term of this patent is extended or adjusted under 35 U.S.C. 154(b) by 165 days.

(21) Appl. No.: 13/244,655

(22) Filed: Sep. 25, 2011

(65) Prior Publication Data

US 2013/0008326 A1 Jan. 10, 2013

(30) Foreign Application Priority Data

Jul. 8, 2011 (CN) ..... 2011 2 0238963 U

(51) Int. Cl.
*B30B 15/06* (2006.01)

(52) U.S. Cl.
USPC ..... 100/227; 100/229 A; 100/246; 100/266; 100/283

(58) Field of Classification Search
USPC ..... 100/226, 227, 228, 229 A, 260, 266, 100/281, 283, 286, 246
See application file for complete search history.

(56) References Cited

U.S. PATENT DOCUMENTS

| | | | | |
|---|---|---|---|---|
| 4,286,515 | A * | 9/1981 | Baumann et al. | 100/233 |
| 4,416,197 | A * | 11/1983 | Kehl | 100/214 |
| 4,593,615 | A * | 6/1986 | Kehl | 100/227 |
| 4,649,813 | A * | 3/1987 | Kehl | 100/227 |
| 6,983,685 | B2 * | 1/2006 | Ko | 100/229 A |
| 7,874,446 | B2 * | 1/2011 | Spivey et al. | 220/254.3 |
| 2009/0000496 | A1 * | 1/2009 | Shahriari | 100/229 A |
| 2011/0126724 | A1 * | 6/2011 | Armstrong | 100/100 |

* cited by examiner

*Primary Examiner* — Jimmy T Nguyen

(57) ABSTRACT

A garbage bin cover with compressing function which has a bin cover and a garbage compression plate. The bin cover is disposed with a through hole. The garbage compression plate is disposed with a handle which corresponds to the through hole. The bin cover is disposed at a bottom side thereof with two or more first connecting members. The garbage compression plate is disposed with two or more corresponding second connecting members. An extendable member is disposed between each of the first connecting members and the corresponding second connecting member. When in use, the garbage compression plate compresses the garbage and thereby decreasing the garbage volume, and preventing the garbage from making the hand or foot dirty and the bad odor from escaping.

5 Claims, 3 Drawing Sheets

GARBAGE BIN COVER WITH COMPRESSING FUNCTION

BACKGROUND OF THE INVENTION

The present invention relates to a garbage bin cover with garbage compressing function.

Garbage bins are indispensable for daily life. Domestic garbage such as waste papers, plastic bags and so forth is loose and bulgy and occupies a lot of space. If the garbage is compressed directly by hand or foot, the hand or foot would get dirty. In many western countries, garbage handling fees are calculated by garbage volume. As a result, it is desired to have a garbage bin cover which is capable of compressing the garbage conveniently without requiring the user to touch the garbage.

BRIEF SUMMARY OF THE INVENTION

In view of the aforesaid disadvantages now present in the prior art, the present invention provides a garbage bin cover with garbage compressing function which is simple in structure, convenient and practical, as well as clean and sanitary.

To attain this, the garbage bin cover with compressing function of the present invention comprises a bin cover and a garbage compression plate. The bin cover is disposed with a through hole. The garbage compression plate is disposed with a handle which corresponds to the through hole. The bin cover is disposed at a bottom side thereof with two or more first connecting members. The garbage compression plate is disposed with two or more second connecting members which correspond to the first connecting members. An extendable member is disposed between each of the first connecting members and the corresponding second connecting member. The extendable member comprises a first coupling rod, a second coupling rod hingedly connected with the first coupling rod, and a spring rod connected between the first coupling rod and the second coupling rod. When the garbage bin is full, hold the handle of the garbage compression plate by hand and push the garbage compression plate downwards. The downward movement of the garbage compression plate compresses the garbage and decreases the garbage volume. When the handle is released, the garbage compression plate moves upwards owing to the resilient action of the extendable member, so that the garbage compression plate returns to its original position automatically.

Telescopic cylindrical members which enclose the through hole are disposed between the bottom side of the bin cover and the garbage compression plate. The cylindrical members ensure that no garbage or bad odor would escape from the garbage bin when the garbage is being compressed by the garbage compression plate, thereby preventing the hand from getting dirty or smelly and the environment from getting polluted.

The bottom side of the bin cover is disposed with three first connecting members.

The garbage compression plate is disposed with three second connecting members.

Three extendable members are disposed between the first connecting members and the second connecting members.

In comparison with the prior art, the present invention has the following advantages: When in use, if there are more garbage in the garbage bin, the garbage could be compressed by the compressing function of the bin cover, so that garbage volume could be decreased, garbage handling fees could be reduced, and garbage clearing frequency could also decrease. Besides, the garbage compression plate could cover the garbage and prevent the garbage from making the hand or foot dirty and the bad odor from escaping.

DETAILED DESCRIPTION OF THE INVENTION

Embodiment 1

Figure 1:
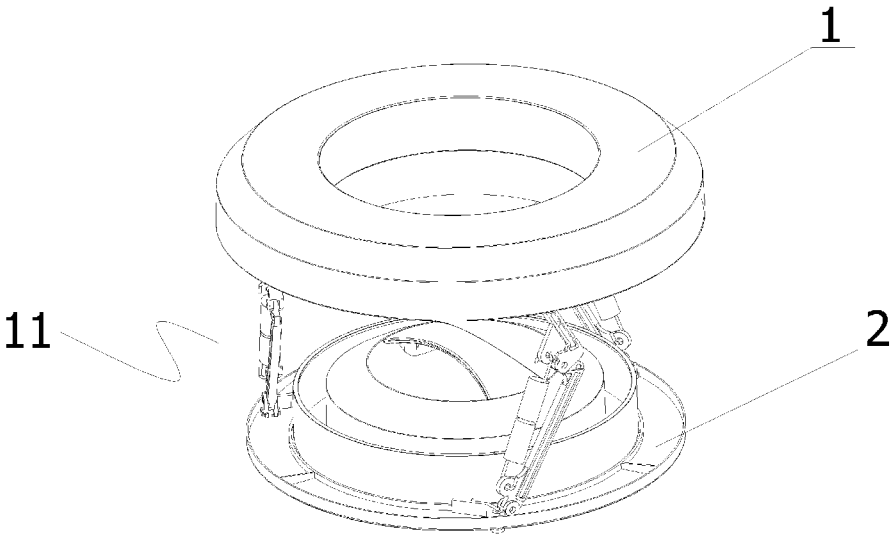
FIG. 1 shows the first embodiment of the present invention in the compression state.
Figure 2:
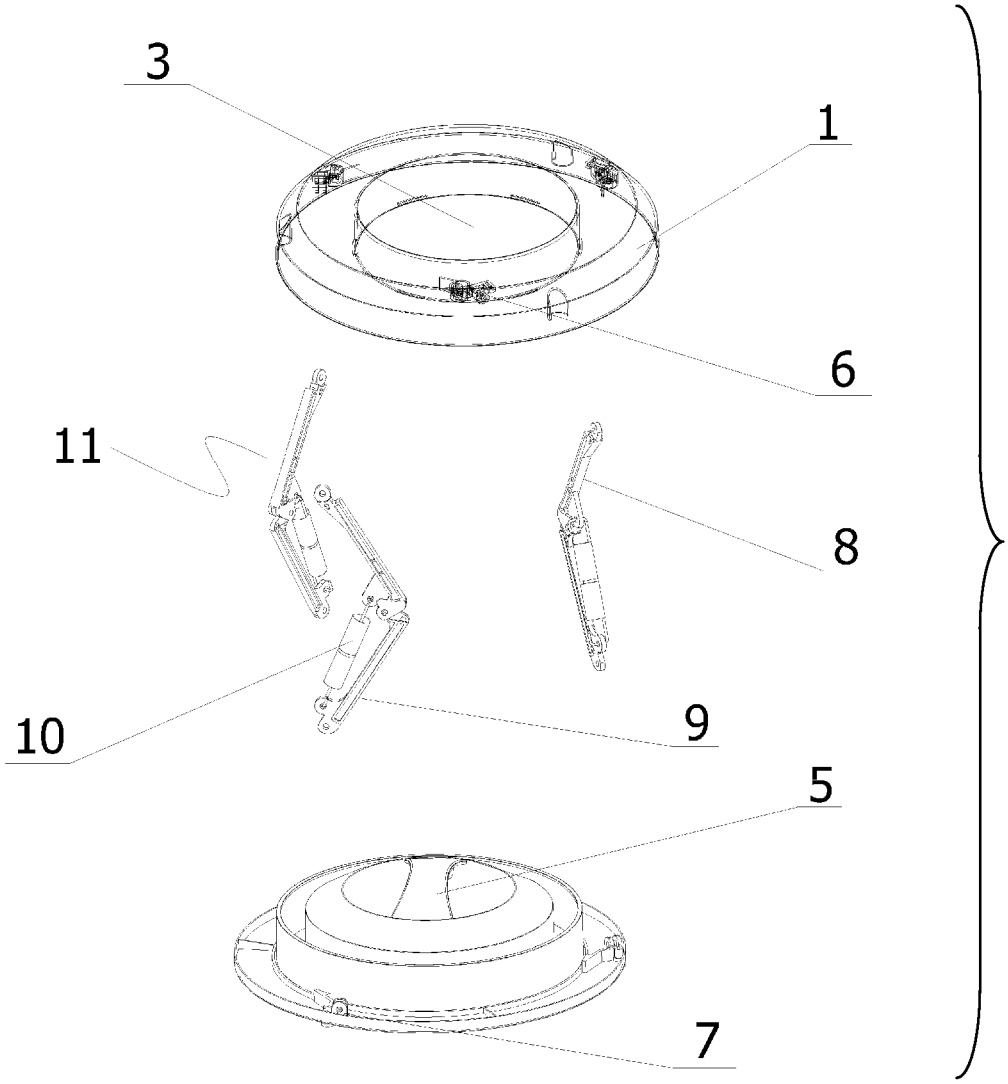
FIG. 2 shows a disassembling view of the first embodiment of the present invention.

As illustrated in FIGS. 1 and 2, the garbage bin cover with compressing function of the first embodiment of the present invention comprises a bin cover 1 and a garbage compression plate 2. The bin cover 1 is disposed with a through hole 3. The garbage compression plate 2 is disposed with a handle 5 which corresponds to the through hole 3. The bin cover 1 is disposed at a bottom side thereof with three first connecting members 6. The garbage compression plate 2 is disposed with three second connecting members 7 which correspond to the first connecting members. Three extendable members 11 are disposed between the first connecting members 6 and the second connecting members 7 respectively. The extendable member 11 comprises a first coupling rod 8, a second coupling rod 9 hingedly connected with the first coupling rod 8, and a spring rod 10 connected between the first coupling rod 8 and the second coupling rod 9. When the garbage bin is full, hold the handle of the garbage compression plate by hand and push the garbage compression plate downwards. The downward movement of the garbage compression plate compresses the garbage and decreases the garbage volume. When the handle is released, the garbage compression plate moves upwards owing to the resilient action of the extendable member, so that the garbage compression plate returns to its original position automatically.

Embodiment 2

Figure 3:
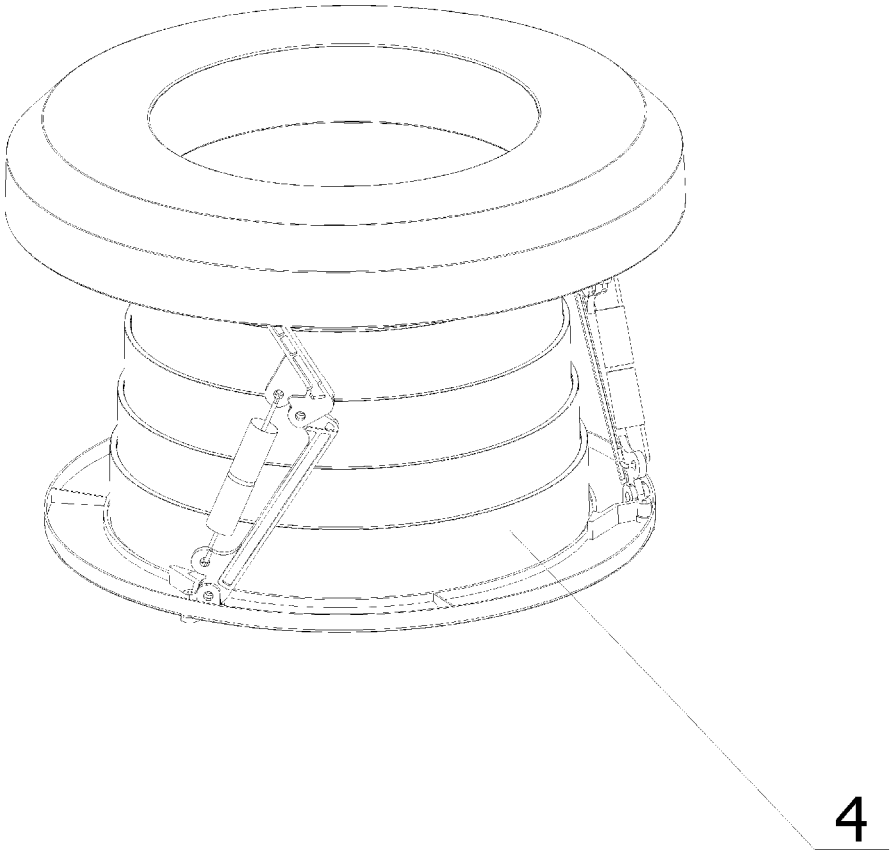
FIG. 3 shows the second embodiment of the present invention in the compression state.

The second embodiment of the present invention has made the following changes based on the first embodiment:

As illustrated in FIG. 3, the bin cover, the extendable members, the garbage compression plate and the through hole are the same as those in the first embodiment. Telescopic cylindrical members 4 which enclose the through hole are disposed between the bottom side of the bin cover and the garbage compression plate. The cylindrical members ensure that no garbage or bad odor would escape from the garbage bin when the garbage is being compressed by the garbage compression plate, thereby preventing the hand from getting dirty or smelly and the environment from getting polluted.

The above embodiments are preferred embodiments of the present invention and should not be considered as limiting the structure of the present invention in any way. Any other variation, decoration or substitution made to the above embodiments not deviated from the spirit of the present invention falls within the scope of protection of the present invention.

What is claimed is:

1. A garbage bin cover with compressing function which comprises a bin cover (1) and a garbage compression plate (2); the bin cover (1) is disposed with a through hole (3); the garbage compression plate (2) is disposed with a handle (5) which corresponds to the through hole (3); the bin cover (1) is disposed at a bottom side thereof with two or more first connecting members (6); the garbage compression plate (2) is disposed with two or more second connecting members (7)

which correspond to the first connecting members; an extendable member (11) is disposed between each of the first connecting members (6) and the corresponding second connecting member (7); the extendable member (11) comprises a first coupling rod (8), a second coupling rod (9) hingedly connected with the first coupling rod (8), and a spring rod (10) connected between the first coupling rod (8) and the second coupling rod (9).

2. The garbage bin cover with compressing function as in claim 1, wherein telescopic cylindrical members (4) which enclose the through hole (3) are disposed between the bottom side of the bin cover (1) and the garbage compression plate (2).

3. The garbage bin cover with compressing function as in claim 2, wherein the bottom side of the bin cover (1) is disposed with three first connecting members (6).

4. The garbage bin cover with compressing function as in claim 3, wherein the garbage compression plate (2) is disposed with three second connecting members (7).

5. The garbage bin cover with compressing function as in claim 4, wherein three extendable members (11) are disposed between the first connecting members (6) and the second connecting members (7).

* * * * *